US010801133B2

(12) United States Patent
Zaglio

(10) Patent No.: US 10,801,133 B2
(45) Date of Patent: Oct. 13, 2020

(54) INTERMINGLING DEVICE AND RELATIVE METHOD

(71) Applicant: Sergio Zaglio, Castiglione delle Stiviere (IT)

(72) Inventor: Sergio Zaglio, Castiglione delle Stiviere (IT)

( * ) Notice: Subject to any disclaimer, the term of this patent is extended or adjusted under 35 U.S.C. 154(b) by 55 days.

(21) Appl. No.: 16/308,863

(22) PCT Filed: Mar. 29, 2017

(86) PCT No.: PCT/IB2017/051787
§ 371 (c)(1),
(2) Date: Dec. 11, 2018

(87) PCT Pub. No.: WO2017/216648
PCT Pub. Date: Dec. 21, 2017

(65) Prior Publication Data

US 2019/0153631 A1 May 23, 2019

(30) Foreign Application Priority Data

Jun. 17, 2016 (IT) ..... 102016000062580

(51) Int. Cl.
*D02J 1/08* (2006.01)
*D02G 1/16* (2006.01)
*D04B 35/22* (2006.01)

(52) U.S. Cl.
CPC ..... *D02J 1/08* (2013.01); *D02G 1/167* (2013.01); *D04B 35/22* (2013.01)

(58) Field of Classification Search
CPC ..... D02J 1/08; D02G 1/167; D02G 1/125; D02G 1/16; D04B 35/22; D06B 3/04; D06B 3/045; D06B 3/06; D06B 3/34; D06B 3/345; D06B 3/36; D06B 17/04
USPC ..... 28/248, 250, 251
See application file for complete search history.

(56) References Cited

U.S. PATENT DOCUMENTS 2,803,939 A * 8/1957 Steele ..... D01H 1/00 57/58.65
3,710,461 A * 1/1973 Benson ..... D02G 1/16 28/252
4,335,588 A * 6/1982 Bos ..... D04B 35/22 28/248

(Continued)

FOREIGN PATENT DOCUMENTS

EP 0685581 A1 12/1995
EP 1151159 A1 11/2001
WO 0047805 A1 8/2000

*Primary Examiner* — Amy Vanatta
(74) *Attorney, Agent, or Firm* — Volpe and Koenig, P.C.

(57) ABSTRACT

A thread intermingling device for textile machines includes a nozzle oriented to intercept the path of the base threads, a corresponding compressed-air feed line and intercepting means to intercept the line. The base threads are led next to the nozzle and impinged by a jet of compressed air causing intermingling. A control unit controls the intercepting means for shutting down the feed to the nozzle instantaneously or with delay with respect to the device stop and for reactivating the feed of compressed air to the nozzle instantaneously or in advance with respect to the device restart, and for the feedback automatic reactivation depending on the detected speed or movement of base threads.

14 Claims, 3 Drawing Sheets

(56) References Cited

U.S. PATENT DOCUMENTS

| | | | | | |
|---|---|---|---|---|---|
| 4,404,718 | A * | 9/1983 | Tajiri | D02G 1/167 | 28/220 |
| 4,570,312 | A * | 2/1986 | Whitener, Jr. | D02J 1/08 | 28/248 |
| 4,627,474 | A * | 12/1986 | Tholander | D03D 47/367 | 139/452 |
| 4,896,407 | A * | 1/1990 | Haynes | D02G 1/167 | 28/248 |
| 5,680,684 | A * | 10/1997 | Musha | D02J 1/08 | 28/271 |
| 5,937,915 | A * | 8/1999 | Wahhoud | D02J 1/08 | 139/435.2 |
| 6,467,314 | B1 * | 10/2002 | Zaglio | D03J 1/04 | 139/450 |
| 2014/0053381 | A1 * | 2/2014 | Boetsch | D02G 1/125 | 28/249 |

* cited by examiner

INTERMINGLING DEVICE AND RELATIVE METHOD

FIELD OF THE INVENTION

The present invention relates to a yarn coupling device for the textile industry, and to the method at the basis of its operation, which is preferably provided upstream of the textile machines.

STATE OF THE ART

In the textile industry, the use of the so-called interminglers is known, which have the task of coupling two or more threads, or baves, to create a single yarn to be fed to a textile machine or to be wound on cone-to-cone winding machines.

The coupling of two or more threads can be carried out according to various techniques, depending on whether intermingled yarns, twisted yarns or core-twisted yarns have to be obtained, as will be now explained.

An intermingled yarn consists of a plurality of threads, or baves, joined at intermingled points spread randomly along the yarn itself.

The intermingling is usually achieved by passing the threads, or baves, through a turbulent air jet; the jet causes threads or baves to be wound, and the formation of the randomly intermingled points mentioned above.

The utility of this technical solution consists in being able to couple different kinds of threads or baves, such as a thread of synthetic material, an elastic thread, a cotton thread, a wool thread, an acrylic thread, etc., in order to obtain a single yarn having mechanical and aesthetic features different from what would be found with base baves or threads only.

Intermingled yarns are particularly appreciated in the field of knit and sock productions where, in last years, there is the trend of using the intermingling technique to couple base threads with elastomeric threads, the latter lending special elasticity to the knit or sock.

Document EP 1151159 describes an intermingling device that can be fed with two or more base threads and, in turn, feeds the intermingled yarn to circular or flat textile machines for producing fabrics, knits, socks, etc. The base threads are conveyed and moved forward near a nozzle from which a jet of compressed air comes out. The jet intensity is sufficient to couple the threads to one another at the intermingled points, as the threads run in front of the nozzle. The so-obtained intermingled yarn is accumulated on windings on a drum, from which it is drawn by the textile machine placed downstream of the intermingling device.

The device further comprises an electric motor and a respective control unit. On the electric motor the following parts are keyed:

- the pulleys rotating the elastomer spools;
- the pulleys rotating the spools of one or more base threads, to obtain the unwinding of threads;
- the drum accumulating the intermingled yarn for the use by a textile machine or a cone-to-cone winding machine.

The diameter difference between the pulleys feeding the elastic thread and the base thread/s allows the elastic thread to be drawn, so that desired elastic features can be lent to the intermingled yarn. The same result can be achieved by providing two motors, one for unwinding the spool of elastomer thread and the other for unwinding additional base threads.

It has to be considered that spools do not slide with respect to respective pulleys, but the rotation is imparted just by the pulleys with no relative slide with the spools. De facto, this entails the spool mass to be added to the mass of the shaft of the electric motor and to the mass of the pulleys, when the inertia of the electric motor is calculated.

The device described in document EP 1151159 suffers from a drawback due to the use with textile machines which intermittently supply with the intermingled yarn, such as for example in case of machine for sock production. When the number of intermingled yarn windings being on the accumulating drum is sufficient to satisfy the demand of the downstream textile machine, the control unit keeps the electric motor in stand-by, i.e. not running, condition; in this case, the base threads are still, that is to say they do not move longitudinally in front of the nozzle.

However, the stop of the electric motor does not always occur in expected times; essentially, this is due to the inertia of thread spools rotated by the pulleys keyed on the shaft of the electric motor. For example, a spool of about 15 cm or 16 cm diameter and initial weight (with a new spool) between 700 grams and 1 kilogram, is rotated by the pulleys at about 4500 rpm. As the thread is unwound from the spool, the weight and the diameter of the spool itself decrease and, therefore, also the times necessary to achieve a complete stop of the spool, the respective pulley and the shaft of the electric motor, change.

The person skilled of the art will certainly comprise that the time for stopping the spool, and therefore the times for starting the rotation to the nominal speed, will change considerably as the spool change size and weight, because the thread is unwound. In other words, the electric motor breaks more and more rapidly to the complete stop as the spool lightens; restarts from stopped condition become quicker as the spool lightens.

Therefore, user's adjustments concerning the stop and restart of air compressed feed to the nozzle can be not always the best, i.e. the most appropriate, as the spool inertia changes and, therefore, the inertia of the electric motor of the interminingler changes. For example, the compressed air may be stopped with such an over-delay to involve non-homogeneous intermingling; on the other hand, if a depleted spool is replaced with a new and heavier one, during the first stops a shutting down of compressed air jet can happen before the threads are quite still and, consequently, a not-intermingled yarn lengths would be obtained.

When the number of windings of intermingled yarn, which are on the accumulating drum, decreases beyond a threshold value considered not sufficient to satisfy the request of the downstream textile machine, the control unit controls the start of the electric motor and the intermingling device resumes the intermingling operation of the base threads, which are again driven in front of the nozzle. Also in this case, if weight and diameter of the spools changed with respect to initial values, when the spools have been loaded, the restore times of the jet of compressed air could not be the best possible referring to time the electric motor needs for returning the spools to the nominal speed, after a restart from stopped condition, and when the spool is replaced.

An appropriate sensor detects the number of windings of intermingled yarns which are on the accumulating drum and sends a corresponding signal to the control unit.

In practice, the intermingling device described in document EP 1151159 is subjected to continuous starts and stops, whose sequence and duration depend on the amount of intermingled yarn accumulated on the drum, which in turn depends on the request of the textile machine downstream of the intermingling device itself. However, at any time the feed of compressed air to the nozzle is independent of the effective movement of the motor shaft, and this involves irregularities in the fiber intermingling which cannot be subjected to any air jet, consequently there can be lengths of not-intermingled yarn.

The reason is that the intermingling of base threads must be guaranteed along the whole extent of the intermingled yarn, i.e. there cannot be lengths of yarn which are not intermingled. In a company, the number of intermingling devices contemporaneously fed with compressed air can be high, in the order of tens or hundreds.

Moreover, if the compressed air jet may hit the same length of threads for long time the breaking of one or more threads could be caused, or else defects in the intermingled yarn can be caused. The base thread could be even broken, if it is particularly sheer, for example less than 8 deniers.

EP-A-0685581 describes another solution according to the known art.

SUMMARY OF THE INVENTION

Object of the present invention is to provide an intermingling device and a method which solve the limits of conventional solutions, thus allowing quality intermingled yarns to be obtained and, at the same time, costs linked to the use of compressed air to be minimized.

Therefore, in its first aspect the present invention concerns a method according to claim 1 to achieve an intermingled yarn from two or more base threads.

In particular, the method comprises the steps of:

a) driving the base threads near a nozzle fed with compressed air to achieve the intermingling, and accumulating the so-obtained intermingled yarn in windings on an accumulating drum;

b) detecting the amount of intermingled yarn accumulated on the drum, for example by detecting the number of windings, and c) aborting step a), by stopping the base threads, when the amount of intermingled yarn detected in step b) exceeds a threshold value, and d) restarting step a), when the amount of intermingled yarn detected in step b) comes down said threshold value.

The afore described steps can be carried out, for example, by an intermingling device driven intermittently, as usually happens in case wherein the device has to provide the intermingled yarn to a textile machine that, in turn, is subjected to continuous starts and stops, which is the case of machines for making socks.

Differently from the so far used solutions, the method according to the present invention provides additional steps whose purpose is to avoid the waste of compressed air or the production of low-quality intermingled yarn, by increasing the quality standards of the intermingled yarn.

The additional steps are:

e) detecting the speed of the driven base threads, or detecting whether the base threads are moving or not, f) shutting down the feed of compressed air to the nozzle concurrently with step c) or with delay from step c), or rather contemporaneously with the stop of the base threads or else after the base threads stopped, and g) reactivating the feed of compressed air to the nozzle before step d) or contemporaneously with step d), or rather before or contemporaneously with respect to time when base threads restart moving longitudinally, wherein steps f) and g) are feedback carried out on the basis of the detected speed of the base threads or depending on whether the movement of the base threads is detected or not (threads still for step f and threads moving for step g).

It is convenient to underline that step e) of detecting the speed of the base threads can be carried out automatically, in two modes: through a direct measurement or an indirect measurement.

In the first mode, the speed of at least one of the base threads is detected by means of one or more sensors, for example movement sensors. The sensors detect the instant velocity of the at least one base thread with a sufficiently high sample frequency (for example calculated by using the Nyquist theorem and considering the maximum speed the yarn can reach).

In the second mode, the rotation speed of at least one spool, from which one of the base threads is withdrawn, is detected. The detection of the instant velocity can be carried out by appropriate sensors, for example an encoder, and by detecting the number of revolutions of a pulley rotating the spool or the number of revolutions of a motor shaft of an electric motor rotating the pulley.

The movement of the base threads can be detected, for example, by appropriate movement sensors of the type used in the textile field.

Preferably the time slots described in steps f) and g), i.e. the time intervening between the real stop or the real start of the base threads—real because is detected—and the delay or advance, can be adjusted by the user.

Once the adjustment has been set, the intermingling device carries out steps f) and g) automatically depending on such adjustment, anyway subordinately to the detection of the real speed or the real movement of the base threads.

In practice, taking care of forbidding the jet of compressed air only after the base threads stopped, allows the air compressed not to be wasted uselessly and, at the same time, a length of not-intermingled yarn not to be gathered on the accumulating drum. In fact, this is the risk on shutting down the feed of compressed air before the base threads stopped. The current state of the art provides for adjusting a delivery time of excess air with respect to the power-supply shutting down, in order to prevent to have not-intermingled lengths. Hence, the saving that can be obtained, in terms of annual electric power consumption pertaining to industrial compressors used in a middle size production unit—provided with tens or hundreds of intermingling devices contemporaneously operating—can be quantified in several thousands of Euros.

Steps f) and g) can be carried out by providing the intermingling device with a compressed air on/off valve, or with equivalent means, subject to the control unit.

The possibility of adjusting the time slots relating to the shutting down and the re-establishment of the jet of compressed air allows the maximum compatibility with the production process needing the intermingled yarn to be found, thus freeing the result from the change of inertia of the thread spools during the process, as the spools are depleting.

Preferably, at least one of steps c) and d), and preferably both, are respectively carried out by gradually slowing down and accelerating the base threads. More particularly, the slowing down and/or acceleration of the base threads follow corresponding deceleration and acceleration ramps in a Cartesian plane having time abscissa and frequency ordinate. As explained above, the real inertia of the thread spools is considered, i.e. the thread stop is not taken for granted to happen in supposed times, but the real thread speed is measured or anyway the thread running is detected, directly or indirectly, in order to understand if the stop or start have been reached actually.

Preferably, step f) is carried out with a delay between 0 millisecond and 500 milliseconds with respect to step c).

Preferably, step g) is carried out with an advance between 0 millisecond and 500 milliseconds with respect to step d).

A second aspect of the present invention concerns an intermingling device according to claim 6.

In particular, the intermingling device comprises at least one electric motor, and a pulley (or roller) and an accumulating drum which are rotated by the electric motor, for example keyed to the shaft of the electric motor. Task of the pulley is to rotate the bobbins of base threads, to obtain the unwinding at the desired speed, and task of the accumulating drum is to receive windings of intermingled yarn. In practice, the accumulating drum operates as a "reserve" of intermingled yarn to allow the downstream machine to be supplied effectively.

The device comprises a nozzle oriented to intercept the path of the base threads, and a corresponding feed line of compressed air. The base threads are led next to the nozzle to be impinged by the respective compressed air jet causing the intermingling. The nozzle is then arranged along the path the base threads run between the respective bobbins and the accumulating drum.

The intermingling device further comprises a sensor detecting, directly or indirectly, the number of windings of intermingled yarn which are on the accumulating drum. A control unit of the intermingling device comprises program means, for example an electrical circuit, and is programmed to feedback drive the start and stop of the electric motor on the basis of the number of windings the sensor detected.

The detection frequency of the windings by the appropriate sensor is adjustable; for example, the sampling can be made 10 times per second.

Advantageously, the intermingling device according to the present invention differs from the known art in that it comprises detecting means to detect the speed or the movement of one or more base threads, and intercepting means to intercept the compressed air the control unit controls in accordance with the two following modes:

f) shutting down the feed of compressed air to the nozzle contemporaneously, or with delay, with respect to the real stop of the base threads, and g) reactivating the feed of compressed air to the nozzle contemporaneously, or with a time advance, with respect to time when the base threads actually restart moving.

The detection of the real base thread speed can be carried out in two modes. In a first embodiment, the device comprises at least one sensor, for example a movement sensor, which detects directly the speed at which at least one base thread runs. In a second embodiment, the device comprises at least one sensor detecting the rotation speed of at least one pulley rotating a base thread spool or detecting the rotation speed of the shaft of the electric motor on which this pulley is mounted.

Whether the base threads are moving or not can be detected by using movement sensors.

The advantages offered by this solution are the same as described afore in connection with the method. In practice, the intermingling device operates automatically and independently, by self-adapting to changeable inertia values of base thread spools, i.e. it is an auto-adaptive device.

Preferably, time advances and delays can be adjusted by the user by means of the control unit, more preferably between 0 millisecond and 500 milliseconds.

In the preferred embodiment, the intercepting means comprises at least one valve, for example an electrovalve, positioned along the feed line of compressed air, upstream of the nozzle with respect to the air flow.

Preferably, the control unit allows the delay duration and/or the advance duration to be adjusted in shutting down or reactivating, respectively, the feed of compressed air. For example, the delay can be set between 0 millisecond and 500 milliseconds with respect to the real stop (detected by one or more sensors) of the electric motor and/or the base thread running.

The activation of the intercepting means to shut down the jet of compressed air can be obtained, for example, with the following five modes.

In a first mode, the control unit feedback controls the intercepting means of the compressed air on the basis of the number of windings detected by the sensor expressly installed on the intermingling device. As afore described, the intercepting means are activated respectively in advance or delay with respect to the start and stop of the electric motor.

In a second mode, the intermingling device comprises an encoder or a speed transducer arranged on the shaft of the electric motor, to detect the speed rotation thereof. The control unit feedback controls the intercepting means of the compressed air on the basis of the detected rotation speed. For example, the control unit can be programmed to shut down the flow of compressed air when the shaft of the electric motor is quite not running. For example, if the stationary electric motor absorbs 5 Hz current, this value can be taken as the minimum threshold under which the motor is considered not running.

In a third mode, the intermingling device comprises permanent magnets mounted on the accumulating drum and a Hall sensor arranged near the drum itself, to detect the speed rotation thereof on the basis of the known Hall principle. The control unit feedback controls the intercepting means of the compressed air on the basis of the rotation speed detected by the Halls sensor connected to such control unit. Since the drum is coupled to the shaft of the electric motor, the proposed solution is an indirect measure of the rotation speed peculiar of the electric motor.

In a fourth mode, the intermingling device comprises movement sensors arranged to detect the movement of corresponding base threads and/or the intermingled yarn. The control unit feedback controls the intercepting means of the compressed air on the basis of the signal said movement sensors generate. For example, the control unit can be programmed to shut down the flow of compressed air when the base threads are completely still.

In a fifth mode, the intermingling device comprises a circuit for detecting the frequency of the signal sent by the control unit to the electric motor, and detecting the current absorbed by the electric motor. This allows a comparison to be made. The control unit feedback controls the intercepting means of the compressed air on the basis of this comparison.

BRIEF LIST OF THE FIGURES

Further characteristics and advantages of the invention will be more evident by the review of the following specification of a preferred, but not exclusive, embodiment, which is depicted for illustration purposes only and without limitation, with the aid of the attached drawings, in which.

DETAILED DESCRIPTION OF THE INVENTION

Figure 1:
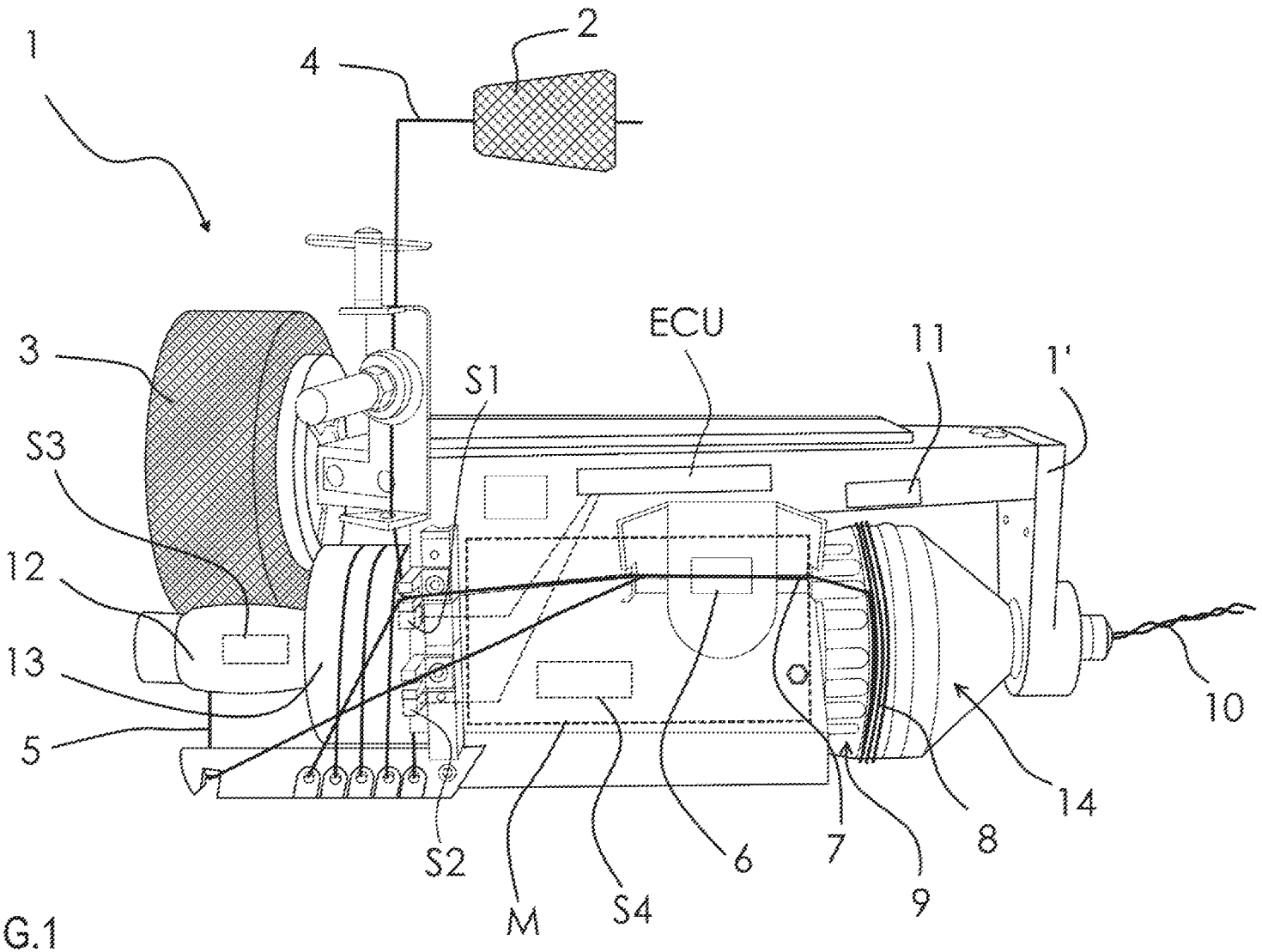
FIG. 1 is a schematic and perspective view of a first embodiment of the intermingling device according to the present invention.

The following detailed description refers to an intermingling device 1 according to a first embodiment of the present invention. All components are housed on the body 1' of the device 1. The corresponding base threads 4 and 5 are withdrawn from two bobbins 2 and 3, for example a nylon base thread 4 and an elastomer base thread 5, which are conveniently guided by thread-guide eyes next to a nozzle 6 fed with compressed air by an outside line (not visible). As previously mentioned, the compressed air jet exiting from the nozzle 6 impinges the base threads 4 and 5 moving in front of the nozzle itself, and this causes the base threads 4 and 5 to be coupled at a plurality of intermingling points spread randomly on the length of the base threads itself. Downstream of the nozzle 6, in the movement direction of the base threads 4 and 5, a single intermingled yarn 7 is therefore obtained. The intermingled yarn 7 is wound in windings 8 on an accumulating drum 9. If necessary for the production cycle, the textile machine fed with the intermingled yarn 7 made by the device 1 withdraws an amount 10 of intermingled yarn from the accumulating drum 9, thereby reducing the number of windings 8 gathered thereon.

An appropriate sensor 11 detects the number of windings 8 being on the accumulating drum 9, with an adjustable sample frequency, for example from 1 time per second to 100 times per second.

An electronic control unit ECU provided with program means, installed in the body 1' of the device 1 as well, controls the functions of the device itself, as it will be described later.

An electrovalve (not shown) is provided along the feed line of compressed air, upstream of the nozzle 6 with respect to the flow direction. The electrovalve is driven by the control unit ECU.

In the body 1' there is also an electric motor M designed to be controlled by the ECU unit. In particular, the ECU unit drives the start of the electric motor M and the stop thereof on the basis of the number of windings 8 which are on the drum 9, in order to guarantee the supply of the intermingled yarn 7 to the textile machine downstream of the device 1, so that the thread 7 will be never missing, that would cause the down time of the textile machine.

In this first embodiment, the control unit ECU receives and processes the signal generated by the sensor 11, which can be for example an optic sensor, and operates as explained above, considering predetermined or adjustable threshold values of the number of windings 8 below which the electric motor M is restarted and above which the electric motor M is stopped.

In fact, the rollers 12 and 13, or pulleys, and the accumulating drum 9 are keyed to the shaft of the electric motor M. The roller 12 rotates the bobbin 3 to cause the unwinding of the thread 5, and the thread 4 winds on the roller 13 to form windings. Since the rollers 12 and 13 have different diameters, the base threads 4 and 5 are pulled with different strains, to obtain the desired drawing. The same result can be obtained by using two motors or by mounting rollers 12 and 13 with the same diameter which however rotate at different speeds, for example by using a reduction gear for one of the two rollers 12 or 13.

If one of the two base threads 4 or 5 has not to be drawn, one of the rollers 12 or 13 can be eliminated or is not fitted.

The accumulating drum 9 is preferably enclosed in a conical bell 14 rotating integrally with the drum 9 itself. The bell 14 is provided with a thread-guide bushing, at the rotation axis of the bell itself and the electric motor M, from which the portion 10 of intermingled yarn 7 comes out. Preferably, the bell 14 is removably constrained to the accumulating drum 9 by means of magnets.

With respect to conventional solutions, the device 1 differs in that the feed of compressed air to the nozzle 6 is not continuous, but it is shut down and reactivated in a controlled way subordinate to the real running of the yarns.

The device comprises at least one sensor among S1, S2, S3 or S4. For example, a sensor S1 is a movement sensor detecting the instant velocity of the thread 4, a sensor S2 is a movement sensor detecting the instant velocity of the thread 5, a sensor S3 is an encoder detecting the number of revolutions of the pulley 12, and a sensor S4 is an encoder detecting the number of revolutions of the shaft of the electric motor M. The sensors S1-S4 are connected to the control unit ECU, to which they send electric signals indicative of the detected speed.

By way of example, the sensors S1 and S2 can be movement sensors of the type marketed by BTSR company (www.btsr.com). Such sensors operate also as means driving the stop of the intermingler in case the yarn would break.

Figure 5:
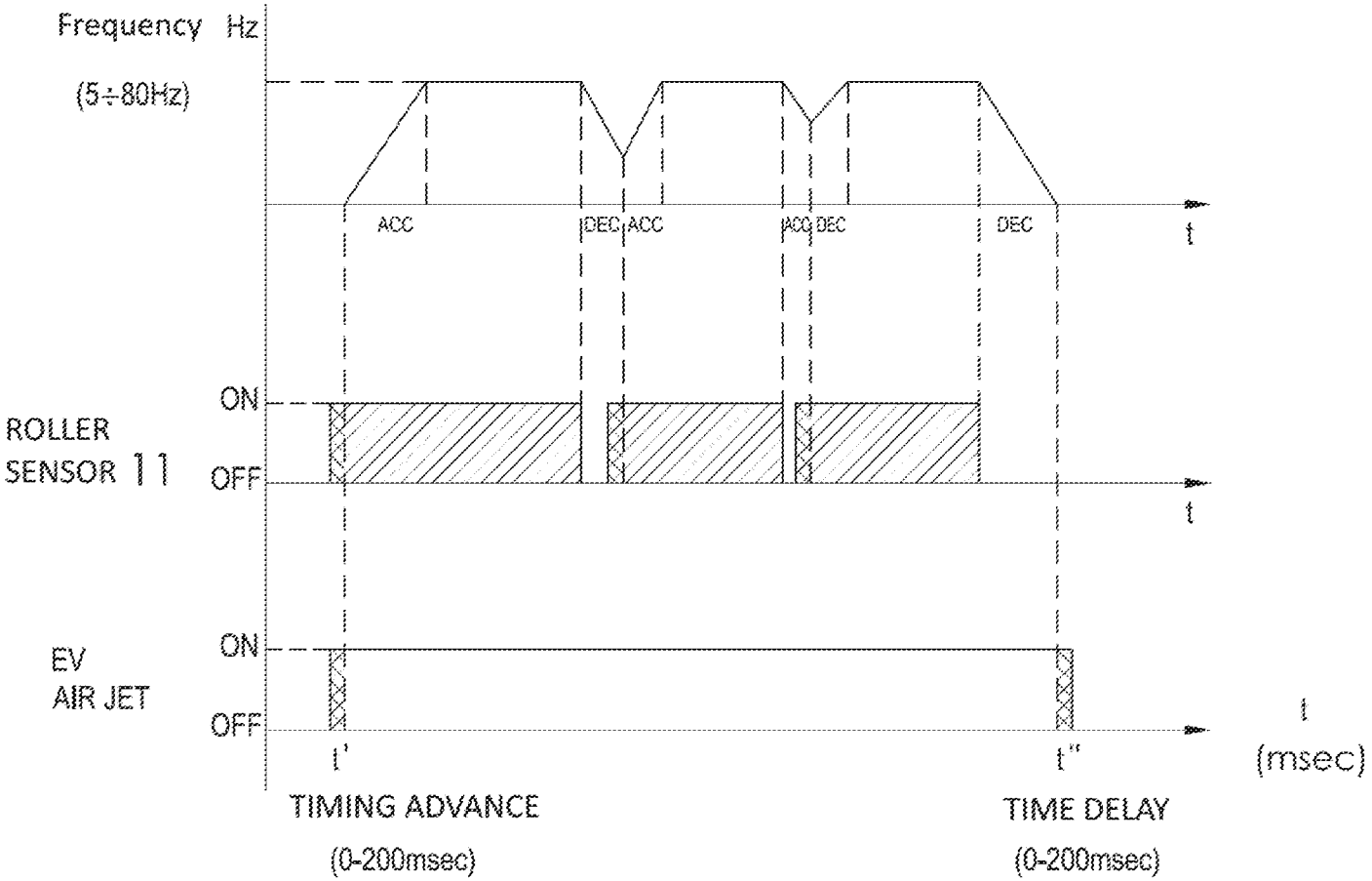
FIG. 5 is frequency—time chart relating to the method according to the present invention.

Referring to FIG. 5, a frequency-time chart is shown, aiding the comprehension of the just described concept. The sensor 11 is designed to send a binary signal to the control unit ECU; the signal can change between ON state, when the number of windings 8 on the drum 9 is low, and OFF state, when the number of windings 8 on the drum 9 is sufficient.

For example, let's consider the case in which the electric motor M is not running and the nozzle 6 is not fed. As time elapses (in abscissa), at a certain point the sensor 11 generates the ON signal (in ordinate) because it detects that the number of windings 8 of the intermingled yarn 7, which are on the accumulating drum 9, is lower than the threshold value. With a time advance t' from 50 to 500 milliseconds with respect to the sending of the start signal to the electric motor M, the control unit ECU opens the electrovalve to reactivate the flow of compressed air to the nozzle 6. Straight after the electric motor M starts and accelerates up to reach the nominal rotation speed, in steady state condition.

As long as the electric motor M is running, the device 1 performs the intermingling of the base threads 4 and 5 and the produced intermingled yarn 7 accumulates on the accumulating drum 9 thus forming the windings 8. At one point the sensor 11 detects that the quantity of windings 8 wound on the accumulating drum 9 exceeded the predefined threshold values and generates the OFF signal. The control unit ECU immediately drives the switching off of the electric motor M, which reaches the completely stopped condition along a deceleration ramp. With a delay t" from 50 to 500 milliseconds with respect to the stop of the electric motor M, the control unit ECU closes the electrovalve to shut down the flow of compressed air to the nozzle 6.

In the example shown in FIGS. 1 and 5, when the control unit ECU drives the motor stop, the latter slows down along a deceleration ramp lasting about 0.8 second. The motor M is provided with an inverter and when the output frequency falls below 3 Hz, direct current is entered by the inverter, which is instructed by the control unit ECU, in two of the phases of the electric motor M for about 0.5 second, and the motor M quite stops in position.

As explained above, in order to avoid the inertia of a great spool, such as the spool 3, from driving the pulley 12 and the shaft of the motor M therewith beyond the desired times, thus defeating the programming of the control unit ECU, the latter adapts automatically its operation on the basis of signals received from a sensor among S1-S4.

Preferably, the time advance t' and the time delay t" can be programmed inside the control unit ECU.

As it can be noted by the observation of FIG. 5, a shadowing time can be programmed, for example of 2 seconds, inside which the control unit does not intervene on the electric motor M even if the sensor 11 changes the signal. This serves for avoiding the shutting down of the compressed-air feed to the nozzle 6, when the switching off and the subsequent restart of the electric motor M are very temporally close, for example so close that the electric motor M has no time to stop completely before the restart thereof is driven.

Figure 2:
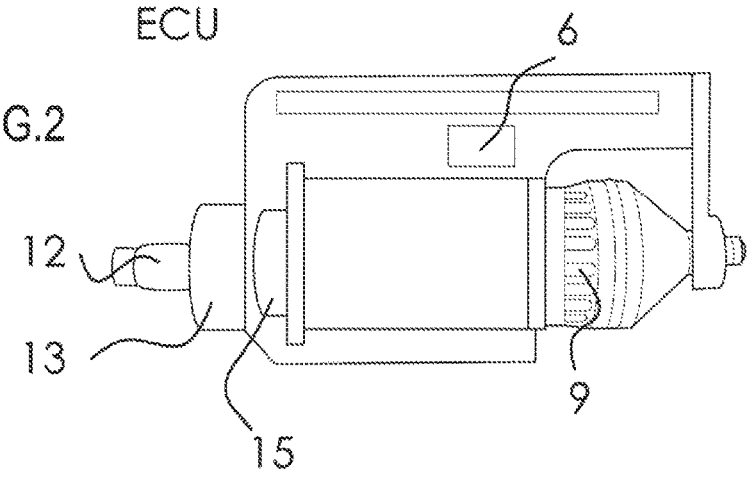
FIG. 2 is a schematic view of a second embodiment of the intermingling device according to the present invention.
Figure 3:
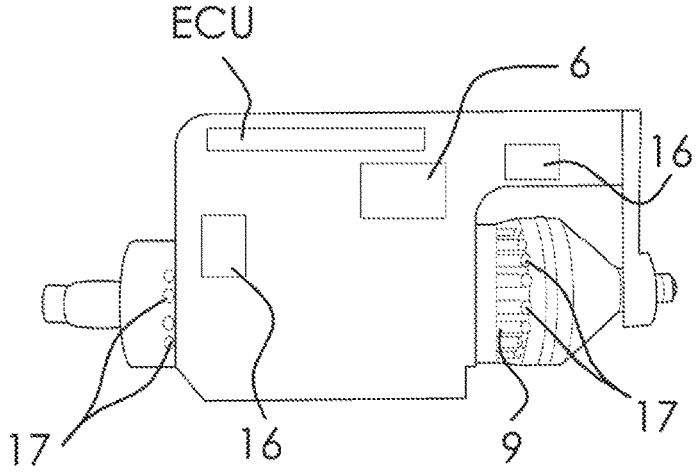
FIG. 3 is a schematic view of a third embodiment of the intermingling device according to the present invention.
Figure 4:
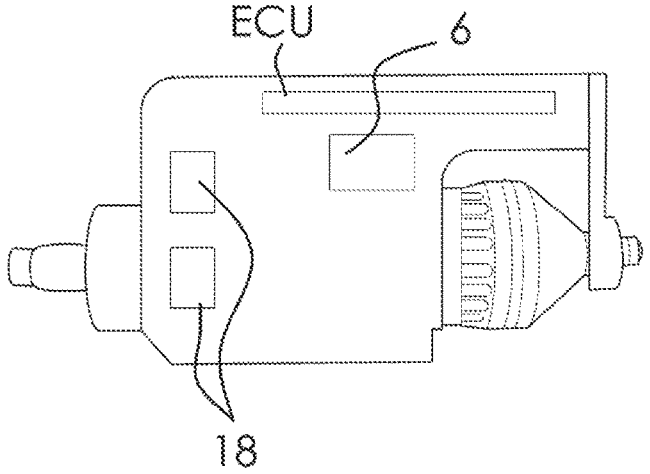
FIG. 4 is a schematic view of a fourth embodiment of the intermingling device according to the present invention.

FIGS. 2-4 show, only schematically, corresponding embodiments of an intermingler 1 according to the present invention.

In the example shown in FIG. 2, a rotary encoder 15 or a speed transducer is combined with the electric motor M (not shown for simplicity) and detects the number of revolutions of the shaft of the electric motor M. For example, the encoder has resolution of 50/100/200/500/1000 pls/rev. and is positioned directly on the shaft of the motor M. The control unit ECU acquires the signal provided by the encoder 15 to drive the motor itself and the electrovalve, as described above in connection with the first embodiment.

FIG. 3 shows an alternative in which the number of revolutions of the electric motor M is detected by using a Hall sensor 16 and a plurality of permanent magnets 17 mounted on board of the accumulating drum 9 or the respective bell 14, or else on board of the pulleys 12 or 13. The Hall sensor 16 detects the passage of the magnets 17 when the device 1 is operating and transmits a corresponding signal to the control unit ECU. The control unit ECU processes the signal provided by the Hall sensor 16 to drive the motor M itself and the electrovalve, as described above in connection with the first embodiment.

FIG. 4 shows an alternative in which the number of revolutions of the electric motor M is detected by using optic sensors 18 positioned along the path of the base threads 4 and 5. When the device 1 is operating, the sensors 18 transmit corresponding signals to the control unit ECU, which are indicative of the presence and the movement of the base threads 4 and 5. The control unit ECU processes these signals to drive the motor M itself and the electrovalve, as described above in connection with the first embodiment. Alternatively, a sensor 18 can be positioned along the path of the intermingled yarn 7 to detect the movement thereof.

The invention claimed is:

1. A method for intermingling two or more base threads (4, 5), comprising the steps of:

a) driving the base threads (4, 5) near a nozzle (6), feeding compressed air to the nozzle to achieve the intermingling, obtaining an intermingled yarn, and accumulating the intermingled yarn (7) in windings (8) on an accumulating drum (9);

b) detecting an amount of intermingled yarn (7) accumulated on the drum (9), and c) stopping the driving of the base threads (4, 5), when the amount of intermingled yarn (7) detected in step b) exceeds a threshold value, and d) restarting the driving of the base threads (4, 5) when the amount of intermingled yarn (7) detected in step b) is below said threshold value, e) detecting a speed of the base threads (4, 5) or detecting whether the base threads (4, 5) are moving or not, f) shutting down the feed of compressed air to the nozzle (6) contemporaneously, or with a time delay (t"), with respect to step c), and g) reactivating the feed of compressed air to the nozzle (6) contemporaneously, or with a time advance (t'), with respect to step d), wherein steps f) and g) are feedback carried out on the basis of the detected speed of the base threads or depending on whether the base threads are still or moving, respectively, in order to avoid wastage of compressed air and a jet too long impinging on the same portion of the base threads (4, 5), or a jet shutting down too early thus resulting in an un-intermingled portion of the yarn.

2. The method according to claim 1, wherein the delay and/or advance of steps f) and g) are adjustable.

3. The method according to claim 1, wherein at least one of steps c) and d), are carried out by providing for a gradual slowing down and acceleration, respectively, of the base threads (4, 5).

4. The method according to claim 3, wherein the slowing down and/or acceleration of the base threads (4, 5) follow corresponding deceleration and acceleration ramps.

5. The method according to claim 1, wherein step f) is carried out with a delay between 0 millisecond and 500 milliseconds with respect to step c) and/or wherein step g) is carried out with an advance between 0 millisecond and 500 milliseconds with respect to step d).

6. An intermingling device (1), for intermingling two or more base threads (4, 5) and obtaining an intermingled yarn, the device comprising:

at least one electric motor (M), and at least one pulley (12, 13) and an accumulating drum (9) both rotated by the at least one electric motor (M), wherein the at least one pulley (12, 13) is for unwinding the base threads (4, 5) from respective spools (2, 3) and wherein the accumulating drum (9) is intended for receiving windings (8) of the intermingled yarn (7), and comprising a nozzle (6) and a corresponding compressed-air feed line, wherein the base threads (4, 5) are led next to the nozzle (6) to be impinged by a respective jet of compressed air causing the intermingling, and comprising a detecting sensor (11) to detect a number of windings (8) of intermingled yarn (7) which are on the accumulating drum (9) and a control unit (ECU) programmed to feedback control start and stop of the at least one electric motor (M) on the basis of the number of windings (8) detected by said sensor (11), further comprising detecting means (S1-S4) to detect a speed or movement of one or more base threads and intercepting means to intercept the compressed air, which are controlled by the control unit (ECU) for shutting down the feed of compressed air to the nozzle (6) contemporaneously, or with a time delay (t"), with respect to a stop of the base threads (4, 5) caused by stopping the at least one electrical motor (M), and reactivating the feed of compressed air to the nozzle (6) contemporaneously, or with a time advance (t'), with respect to time when the base threads actually restart moving as said at least one electrical motor (M) is started, to compensate a changeable inertia of at least one of the spools (2, 3) when an amount of thread (4, 5) decreases and, at the same time, to avoid a wastage of compressed air or the jet too long impinging on the same portion of the base threads (4, 5), or a production of un-intermingled yarn length.

7. The intermingling device (1) according to claim 6, wherein the intercepting means comprise at least one electrovalve placed along the compressed-air feed line, upstream of the nozzle (6).

8. The intermingling device (1) according to claim 6, wherein the delay and/or advance in shutting down or reactivating, respectively, the feed of compressed air are adjustable in the control unit (ECU).

9. The intermingling device (1) according to claim 6, wherein the delay and/or advance are adjustable, respectively, between 0 millisecond and 500 milliseconds with respect to the stop and start of the at least one electric motor (M).

10. The intermingling device (1) according to claim 6, wherein the control unit (ECU) feedback controls the intercepting means of the compressed air on the basis of the number of windings (8) detected by said sensor (11), respectively in advance or delay with respect to the start and stop of the at least one electric motor (M).

11. The intermingling device (1) according to claim 6, further comprising an encoder or a speed transducer (15) arranged on a shaft of the at least one electric motor (M) to detect a rotation speed thereof, and wherein the control unit (ECU) feedback controls the intercepting means of the compressed air on the basis of the detected rotation speed.

12. The intermingling device (1) according to claim 6, further comprising permanent magnets (17) assembled on the accumulating drum or the pulley (12, 13) and a Hall sensor (16) arranged near the accumulating drum (9) or the at least one pulley (12, 13) to detect a rotation speed thereof, and wherein the control unit (ECU) feedback controls the intercepting means of the compressed air on the basis of the detected rotation speed.

13. The intermingling device (1) according to claim 6, further comprising movement sensors (18) arranged for detecting a movement of corresponding base threads (4, 5) and/or of the intermingled yarn (7), and wherein the control unit (ECU) feedback controls the intercepting means of the compressed air on the basis of a signal generated by said movement sensors (18).

14. The intermingling device (1) according to claim 6, further comprising a detecting circuit to detect the frequency of the signal sent by the control unit (ECU) to the at least one electric motor and to detect a current absorbed by the electric motor, and wherein the control unit feedback controls the intercepting means of the compressed air on the basis of the processing of said frequencies of absorbed current.

* * * * *